US006445903B2

(12) United States Patent
Hashimoto et al.

(10) Patent No.: US 6,445,903 B2
(45) Date of Patent: Sep. 3, 2002

(54) IMAGE FORMING APPARATUS HAVING A SHEET REVERSING DEVICE

(75) Inventors: Yasushi Hashimoto; Akira Terakado; Masato Miwa, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/791,863

(22) Filed: Feb. 26, 2001

(30) Foreign Application Priority Data

Feb. 25, 2000 (JP) ..... 2000-049069

(51) Int. Cl.[7] ..... G03G 15/00
(52) U.S. Cl. ..... 399/401
(58) Field of Search ..... 399/361, 381, 399/388, 397, 401, 405; 271/186, 301, 225, 304

(56) References Cited

U.S. PATENT DOCUMENTS 4,928,127 A * 5/1990 Stemmle ..... 271/186 X
4,955,597 A * 9/1990 Johdai et al. ..... 271/215
5,196,897 A * 3/1993 Trask ..... 271/186 X

* cited by examiner

*Primary Examiner*—Sophia S. Chen
*Assistant Examiner*—Hoan Tran
(74) *Attorney, Agent, or Firm*—Sughrue Mion, PLLC

(57) ABSTRACT

In an image forming apparatus, a length of a transporting passage between an induction roller pair and a reversal roller pair and a length of a transporting passage between the reversal roller pair and a feed roller pair are respectively set smaller than the smallest length in the transporting direction of a sheet used in an image forming apparatus. A time till the rotation of the reversal roller pair is switched to the forward rotation after a rear end of the sheet having a length in the transporting passage of 8.5 inch after reversal has passed through the reversal roller pair can be set shorter than a time when a leading end of a succeeding sheet inducted into a pull-in passage reaches the reversal roller pair.

4 Claims, 4 Drawing Sheets

IMAGE FORMING APPARATUS HAVING A SHEET REVERSING DEVICE

BACKGROUND OF THE INVENTION

1. Field of the Invention

The present invention relates to an image forming apparatus having mechanism by which sheets transported one by one are switch-backed, which is typified by a printer, a copier, or the like.

2. Description of the Related Art

An image forming apparatus typified by a printer, a copier, or the like, which can perform automatic duplex printing by switch-backing and reversing sheets transported one by one, has been put to practical use. In such an image forming apparatus, a sheet handling device such as a finisher having an after treatment device that connects to a back stage of the image forming apparatus such as a stacker having a paper tray, a stapler or the like requires a function of exhausting a sheet of which one side has been already printed in a state where its printed side is faced downward (hereinafter referred to as face-down exhaust) in order to readily make up print pages. Further, in case that sheets having binding holes are used, in order to exhaust the sheets in such a manner that the binding-hole directions at the one-sided printing time and at the two-sided printing time are fitted to each other, there is required a function of selectively switching that the sheet of which one side has been already printed is exhausted face-down, and the sheet of which two sides have been already printed is exhausted in a state where the last printed side is faced upward to be exhausted (hereinafter referred to as a face-up exhaust). Accordingly, in a recent image forming apparatus, a sheet reversing device, which has the function of reversing the surface of the already printed sheet and the rear surface and the function of selectively switching the face-up exhaust and the face-down exhaust, is necessary and indispensable in a last paper exhausting section.

FIG. 4 shows one example of the constitution of a paper feeding section in the conventional image forming apparatus that satisfies the above functions. In FIG. 4, a fixing device 9 provided in an image forming apparatus 1 is composed of a heat roller 9*a* and a pressure roller 9*b* that are pressure welded to each other, and a toner image transferred onto a sheet is fixed by this device 9. Reference numeral 10 is a gate and has a function of switching the directions of a sheet to be transported. A sheet transporting passage 12 connecting the fixing device 9 and a paper outlet 11 of the image forming apparatus to each other is referred to as a sheet feeding passage. Further, reference numeral 13*a* is referred to as a pull-in passage and diverges from the sheet feeding passage 12 on the downstream side in the sheet transporting direction in relation to the fixing device 9, and the sheet fed out from the fixing device 9 by the switching control of the gate 10 is selectively pulled in it. Further, reference numeral 13*b* is referred to as a reversed sheet exhausting passage and diverges from a midway divergent point P of the pull-in passage 13*a*, and its end joins the sheet feeding passage 12 on the upstream side of the sheet outlet 11 in the image forming apparatus 1. In FIG. 4, reference numeral 15 is a feed roller pair provided in the front stage of the gate 10, reference numeral 16 is a discharge roller pair in the back stage of the gate 10, and reference numeral 17 is a drive roller of a feed roller pair that is provided on the pull-in passage 13*a* and the reversed sheet exhausting passage 13*b*. Reference numerals 17 and 17*a* constitute an induction roller pair by which the sheet inducted to the pull-in passage 13*a* is put in, and reference numerals 17 and 17*b* constitute a feed roller pair for feeding out the sheet reversed and transported from the reversed sheet exhausting passage 13*b*. Reference numeral 18 is a reversal roller pair that is provided on the pull-in passage 13*a* and can switch its rotation to forward rotation/reverse rotation.

Under the above constitution, in case that the already printed sheet is exhausted face-up, the sheet fed out from the fixing device 9 is intactly exhausted along the sheet feeding passage 12 from the paper outlet 11, and fed out to a sheet handling device 2. Further, in case that the already printed sheet is exhausted face-down, the sheet fed out from the fixing device 9 is pulled in the pull-in passage 13*a* by guide of the gate 10, the reversal roller pair 18 is rotated in the opposite direction to the direction at the pulling-in time at a timing when a sheet rear end reaches the divergent point P in the pull-in passage 13*a*, and the sheet is transported from the reversed sheet exhausting passage 13*b* to the discharge roller pair 16 side and exhausted from the paper outlet 11 to be fed out to the sheet handling device 2 side.

In the above conventional art, in a device that transports sheets at a high speed, such a state occurs frequently that while a preceding sheet is reversed and transported on the reversed sheet exhausting passage 13*b*, a succeeding sheet is inducted to the pull-in passage 13*a*. In case that the sheet that is being reversed and transported and the succeeding sheet cross on the pull-in passage 13*a*, the following problem occurs.

In case that the rear end of the sheet during reversal passes through the reversal roller pair 18 and the succeeding sheet achieves the reversal roller pairs 18 before the rotation of the reversal roller pair 18 is switched to the forward rotation, the succeeding sheet stops in a state where its leading end portion cannot enter in the reversal roller pair 18, so that sheet jam occurs.

In order to solve the above problem, in the conventional image forming apparatus, the following methods are proposed and executed. As a first method, the induction roller pair 17, 17*a* is constituted by the drive roller different from the drive roller of the feed roller pair 17, 17*b*, the transporting velocity at the downstream of the sheet reversing device is heightened, and the reverse rotation velocity of the reversal roller pair 18 is made speedier than the forward rotation velocity thereof thereby to quickly exhaust the reversed sheet. As a second method, nip release mechanism that releases a nip of the reversal roller pair is provided, the nip is released before the succeeding sheet reaches the reversal roller, and two sheets that move in the opposite direction to each other can be existed between the reversal roller pair 18. As a third method, the distance between the preceding sheet and the succeeding sheet is made large.

However, according to the conventional first method, the transporting velocity at the downstream of the sheet reversing device becomes so high in the device transporting the sheets at the high speed that the driving force necessary for sheet transportation becomes large. Further, since consumption of the abrasive system of the sheet transporting device is severe, reliability of the device lowers. Further, since the velocity of the sheet exhausted from the sheet outlet 11 is different between a case that the sheet is reversed and a case that the sheet is not reversed, the sheet handling device 2 must correspond to the velocity of two kinds, so that the constitution of the device becomes complicated. Further, according to the conventional second method, the nip release mechanism so constituted that the drive roller constituting the reversal roller pair 18 is fixed and a pinch roller opposed to the drive roller is constituted separably in relation to the drive roller is simple and cheap in constitution. However, since the drive roller is exposed on the transporting passage, in case that the sheet that moves in the direction opposite to the rotational direction of the aforesaid drive roller passes, the sheet leading end is bent or stained due to action of the relative motion between the drive roller and the sheet, so that there is fear that bad influences on the succeeding sheet transportation and on the print quality occur. As a method for solving this fear, there are a system in which the drive roller is provided separably in relation to the pinch roller, and a system in which the roller on a side corresponding to the pull-in passage 13*a* is used as the pinch roller and the roller on a side corresponding to the reversed sheet exhausting passage 13*b* is used as the drive roller. According to the former system, the constitution becomes complicated as described above, so that a high cost of the apparatus is caused. Further, according to the latter system, since the pull-in passage 13*a* is located generally on the internal side of the apparatus, the nip release mechanism is arranged on the internal side of the apparatus, so that disadvantage that maintenance working becomes complicated occurs. Further, in case that the nip release operation is executed in relation to each sheet, there is fear that reliability lowers due to noise caused by the nip release operation and abrasion of the nip release driving system. Further, according to the conventional third method, since the distance of the sheets to be transported becomes large, through put lowers. Further, in case that delay of the sheet transportation occurs, this third method may not cope with the above problem, so that there is fear that reliability of the apparatus lowers.

SUMMARY OF THE INVENTION

An object of the invention, in order to solve the above defects of the conventional art, is to provide an image forming apparatus having a sheet reversing and exhausting device. This sheet reversing and exhausting device can perform switch back reversal without increasing the transporting velocity after sheet reversal and without releasing a nip in case of a sheet size that is highest in use of frequency, and actuates a nip release operation only in case that the nip release is necessary at a minimum. Further, the sheet reversing and exhausting device further can control the transporting velocity so that after the reversed sheet completely passed through a reversal roller pair also in case that transportation delay of the sheet occurs, a succeeding sheet reaches the reversal roller pair; and also in case that a sheet having a length requiring the nip release is switch-backed and reversed, this sheet reversing and exhausting device can prevent bending and a stain of the sheet that accompany the nip release.

To achieve the above object, according to the invention, there is provided an image forming apparatus having a sheet reversing device that comprising: a pull-in passage which is provided on the way of a first sheet transporting passage connecting a fixing device and an after treatment device to each other, and into which a sheet transported from the first sheet transporting passage is pulled; a reversal roller pair that is provided on the pull-in passage and provided so that it can rotate forward and reversely in order to reverse the advance direction of the sheet; a nip release means for releasing a nip of the reversal roller pair; a first roller pair for transporting the sheets to a reversal passage that diverges from the pull-in passage at a divergent point located upstream of the reversal roller pair and to the pull-in passage; and a second roller pair for transporting the sheet transported from the reversal passage by reverse rotation of the reversal roller pair. And, the sheet reversing device feeds out the sheet from the reversal passage in such a manner that a rear end of the sheet transported on the first transporting passage becomes a leading end in the transporting direction. In the invention, there are provided the sheet reversing device so constituted that the following expression is satisfied, and a control means which, in case of a sheet having a length in the transporting direction of at least 8.5 inch or less, causes the sheet to reverse without the nip release of reversal roller pair:

$$Y>L1>S>\{8.5\ (\text{inch})-X\}/2+V\cdot tY>L2$$

in which Y (inch) is the smallest length in the transporting direction of a sheet used in the image forming apparatus, X (inch) is a distance between a rear end of a preceding sheet and a leading end of a succeeding sheet during sheet transportation, L1 (inch) is a length of the transporting passage between the first roller pair and the reversal roller pair, L2 (inch) is a length of the transporting passage between the reversal roller pair and the second roller pair, S (inch) is a length of the transporting passage between the divergent point and the reversal roller pair, V(inch/sec.) is a sheet transporting velocity in the first sheet transporting passage, and t(sec.) is a time necessary for a deceleration/stop/acceleration step when the rotation of the reversal roller is switched from the forward rotation to the reverse rotation or from the reverse rotation to the forward rotation.

Further, a first sensor is provided on the first transporting passage of downstream of the fixing device of the image forming apparatus and it senses that the sheet has passed through the first roller pair. And, there is provided a control means, which compares a sheet rear end sensing moment by the first sensor with a regular moment, and which, in case that the rear end sensing moment is later than the regular moment, makes the transporting velocity up to the divergent point of the pull-in passage and the reversal passage and the reversing and transporting velocity between the divergent point and the second roller pair higher than the regular transporting velocity.

Further, a roller of the reversal roller pair on a side corresponding to the pull-in passage is constituted as a drive roller and a roller on a side corresponding to the reversal passage is constituted as a pinch roller, and the pinch roller is constituted separably from the drive roller. Further, there is provided a control means which, after the leading end of the sheet was sensed by the first sensor, rotates forward the drive roller of the reversal roller pair before a time when the sheet leading end reaches the reversal roller pair, which is calculated from the position of the reversal roller pair on the pull-in passage, passes.

According to a first aspect of the invention, since a length of the transporting passage between the first roller pair and the reversal roller pair and a length of the transporting passage between the reversal roller pair and the second roller pair are set smaller than the smallest length in the transporting direction of the sheet used in the image forming apparatus, a time till the rotation of the reversal roller pair is switched to the forward rotation after the rear end of the sheet having a length in the transporting passage of 8.5 inch after reversal has passed through the reversal roller pair can be set shorter than a time when the leading end of the succeeding sheet inducted into the pull-in passage reaches the reversal roller pair. Therefore, the sheet having a length in the transporting passage of at least 8.5 inch or less, in a state where it is always nipped by the rollers, can be switch backed and reversed without the nip release of the reversal roll.

According to a second aspect of the invention, since the transportation delay of the sheet before the sheet is inducted to the sheet reversing device can be sensed by the first sensing means, it is possible to correct the transportation delay of the sheet by correcting the transporting velocity of the reversal roller pair in the section where the sheet is transported by only the reversal roller pair.

According to a third aspect of the invention, before the timer starting a clocking operation from the moment when the sheet leading end is sensed by the first measuring means points to a time when the sheet leading end reaches the reversal roller pair, which is calculated from the transporting velocity of the sheet and the distance between the first measuring means and the reversal roller pair, the rotation of the reversal roller pair is switched to the forward rotation.

DETAILED DESCRIPTION OF THE PREFERRED EMBODIMENTS

An embodiment of the invention will be described below with reference to drawings.

Figure 3:
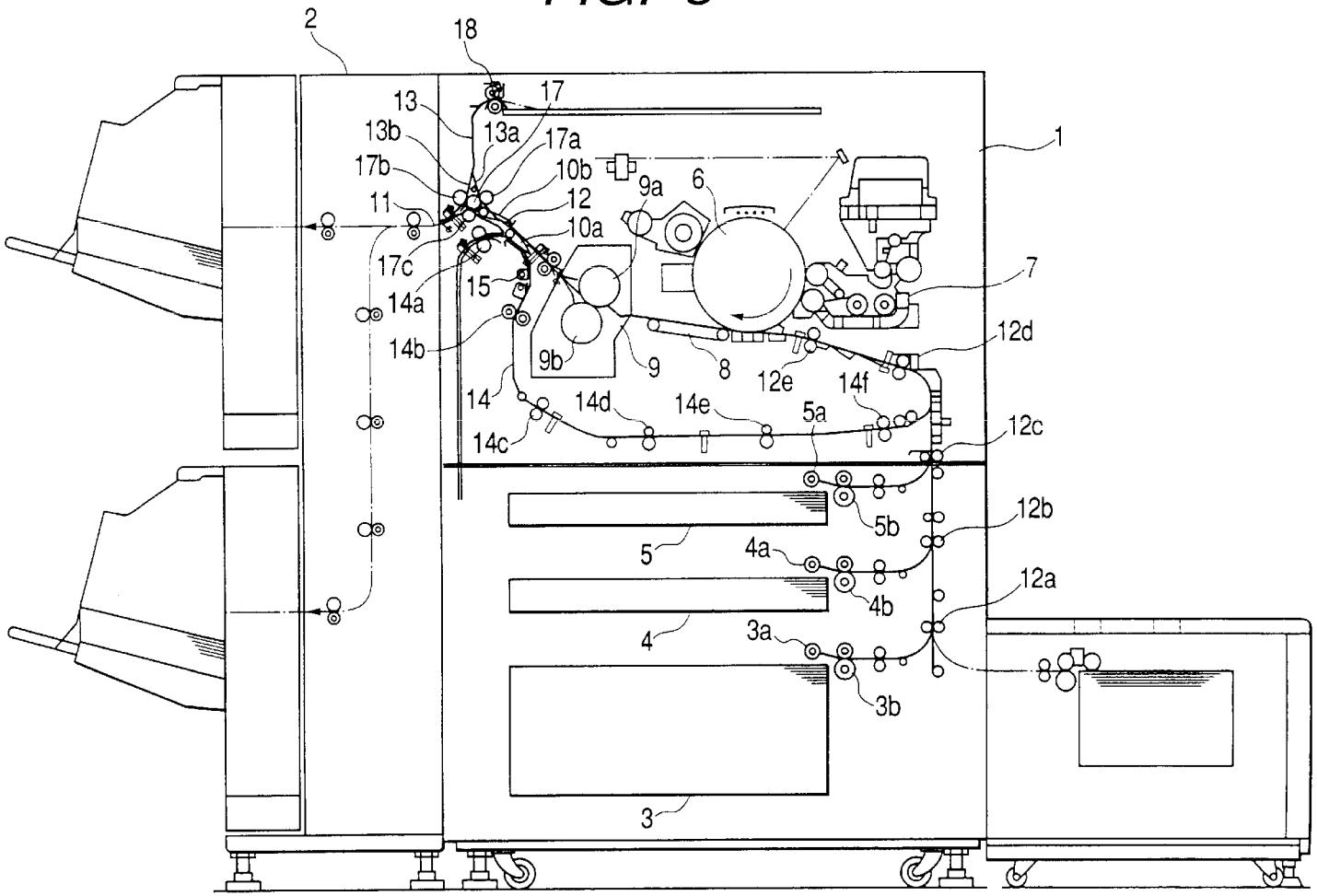
FIG. 3 is a constitutional diagram of the whole of the image forming apparatus of the invention.
Figure 4:
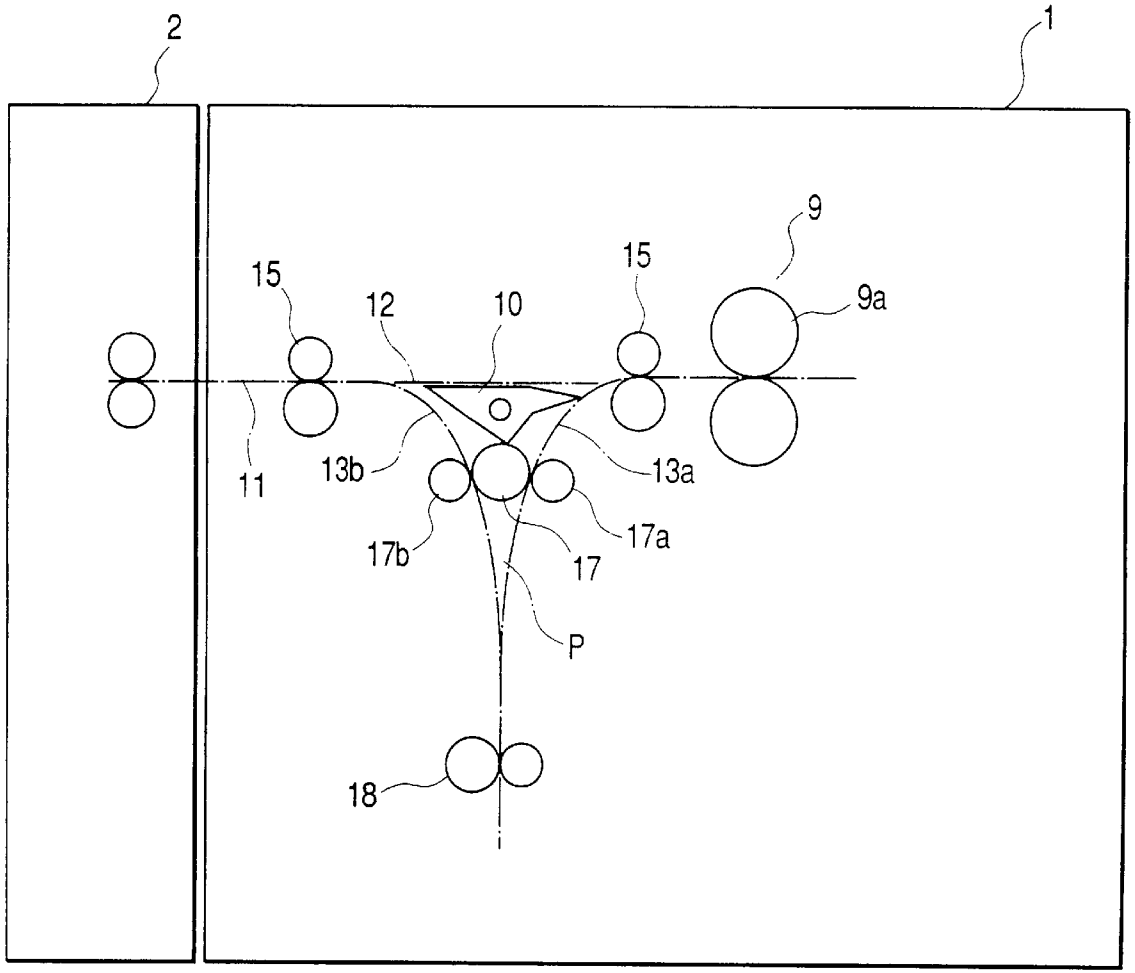
FIG. 4 PRIOR ART
FIG. 4 is an explanatory view showing the constitution of a paper exhausting section in a conventional art.

As shown in FIG. 3, an image forming apparatus system is composed of an image forming apparatus 1 and a sheet handling device 2. In this embodiment, as the image forming apparatus 1, a laser printer is exemplified, which records and forms a toner image on sheet material, using a photoreceptor, by a known electrophotographic process. Further, as the sheet handling device 2, a stacker is exemplified, which stores the sheets exhausted from the printer 1 in a state where they are stacked on a tray.

In the printer 1, reference numerals 3, 4 and 5 are sheet accommodating portions in which sheets as sheet material are stored. Reference numeral 6 is a photoconductive drum, and it starts rotating in a direction of an arrow based on a signal from a controller (not shown). When the photoconductive drum 6 starts rotating, a surface of the photoconductive drum 6 is uniformly charged by a corona charger (not shown). On the charged photoconductive drum 6, an electrostatic latent image is formed by laser beams irradiated from an exposing device (not shown). The electrostatic latent image is developed by toner when it reaches a position of a developing device 7, so that it is made visible on the photoconductive drum 6 as a toner image. The toner image thus formed by the known electrophotographic process is transferred onto the sheet fed out from the sheet accommodating portions 3, 4 or 5, or a return passage 14 which will be described later. Reference numeral 9 is a fixing device, and the fixing device in this embodiment is composed of a heat roller 9*a* and a pressure roller 9*b* that are pressure welded to each other, and fixes the toner image transferred onto the sheet. Reference numerals 10*a* and 10*b* are gates having a function of switching a direction in which the sheet is transported. Reference numeral 13 is a sheet reversing device, which switch-backs and reverses the sheet to be exhausted and has a function of changing a sheet exhausting direction.

Regarding a sheet transporting passage constituted in the printer 1, in the following description, a sheet transporting passage 12 connecting the sheet accommodating portions 3, 4, 5 through image forming means 6, 7, 8, to a sheet outlet 11 of the printer 1 is referred to as a sheet feeding passage as a matter of convenience. Further, reference numeral 13*a* is referred to as a pull-in passage, diverged from the sheet feeding passage 12 on the downstream side in the sheet transporting direction in relation to the image forming means 6, 7, 8 by the gate 10*b*, and selectively pulls the sheets fed out from the fixing device 9 therein by the switching control of the gate 10*b*. Further, reference numeral 13*b* is referred to as a reversed sheet exhausting passage and diverged from the midway of the pull-in passage 13*a*, and its end joins the sheet feeding passage 12 of the upstream of the sheet outlet 11 of the printer 1. Reference numeral 14 is referred to as a return passage and diverged from the sheet feeding passage 12 on the upstream side in the sheet transporting direction in relation to the pull-in passage 13*a* by the gate 10*a*, and its end joins the sheet feeding passage 12 on the upstream side in the sheet transporting direction in relation to the image forming means 6, 7, 8.

In FIG. 3, reference numeral 15 is a feed roller pair provided at the front stage of the gates 10*a* and 10*b*, and 17 is a feed/drive roller of a discharge roller pair which is so constituted that its rotation can be switched to forward or reverse rotation and which is provided on the pull-in passage 13*a*, the reversed sheet exhausting passage 13*b*, and the sheet feeding passage 12 immediately before the sheet outlet 11. Reference numeral 17*a* is a pinch roller constituting an induction roller pair of the pull-in passage 13*a*, which is pressure-welded to the drive roller 17 and so constituted that it can cooperate with the drive roller 17 according to the rotation of the feed/drive roller 17. Reference numeral 17*b* is a pinch roller constituting a feed roller pair of the reversed sheet exhausting passage 13*b*, which is pressure-welded to the feed/drive roller 17 and so constituted that it can cooperates with the drive roller 17 according to the rotation of the drive roller 17. Reference numeral 17*c* is a pinch roller constituting the discharge roller pair provided on the sheet feeding passage 12 immediately before the sheet outlet 11, which is pressure-welded to the feed/drive roller 17 and so constituted that it can cooperate with the drive roller 17 according to the rotation of the feed/drive roller 17. Reference numeral 18 is a reversal roller pair provided on the pull-in passage 13*a*, of which rotation can be switched to forward or reverse rotation.

Under the above constitution, in case that the already printed sheet is exhausted in a face-up state, the sheet fed out from the fixing device 9 is intactly exhausted along the sheet feeding passage 12 through the discharge roller pair 17, 17*c* from the sheet outlet 11 and fed out to the stacker 2. Further, in case that the already printed sheet is exhausted in a face-down state, the feed/drive roller 17 is rotated in the opposite direction to the direction at the face-up exhausting time, the sheet fed out from the fixing device 9 is pulled into the pull-in passage 13*a* of the reversing device 13 through the induction roller pair 17, 17*a* by guide of the gate lob, the reversal roller pair 18 is rotated in the opposite direction to the direction at the pulling-in time at a timing when the sheet rear end reaches a divergent point P in the pull-in passage 13*a* shown in FIG. 1 thereby to switch-back and reverse the sheet, and the sheet is exhausted through the reversed sheet exhausting passage 13*b* and the feed roller pair 17, 17*b* from the sheet outlet 11 thereby to be fed out to the stacker 2.

Further, printing is performed on two sides of the sheet, the sheet fed out from the fixing device 9 is pulled into the return passage 14 by the guide of the gate 10*a*, and by switch-backing and reversing this pulled-in sheet, the sheet of which one side has been already printed is fed to the image forming means 6, 7, 8 again, whereby two-sided printing is executed.

In FIG. 3, reference numerals 3*a*, 4*a* and 5*a* are pick rollers for feeding out the sheets stored in the sheet accommodating portions 3, 4, 5, and reference numerals 3*b*, 4*b* and 5*b* are paper supplying roller pairs, each of which is generally composed of a feed roller and a retard roller. The paper supplying roller pairs 3*b*, 4*b* and 5*b* have respectively a function of supplying the sheets to the sheet feeding passage 12 one by one while they prevents the sheets fed out by the pick rollers 3*a*, 4*a*, 5*a* from being transported in a state where the plural sheets are piled.

Reference numerals 12*a*, 12*b*, 12*c* and 12*d* are feed roller pairs for transporting the sheets in the sheet feeding passage 12*a*, and reference numeral 12*e* is a register roller pair which transports the sheets in synchronization with a timing when the toner image formed on the photoconductive drum 6 is transferred onto the sheet. Reference numerals 14*a*, 14*b*, 14*c*, 14*d*, 14*e* and 14*f* are feed roller pairs for transporting the sheets in the return passage 14.

Figure 1:
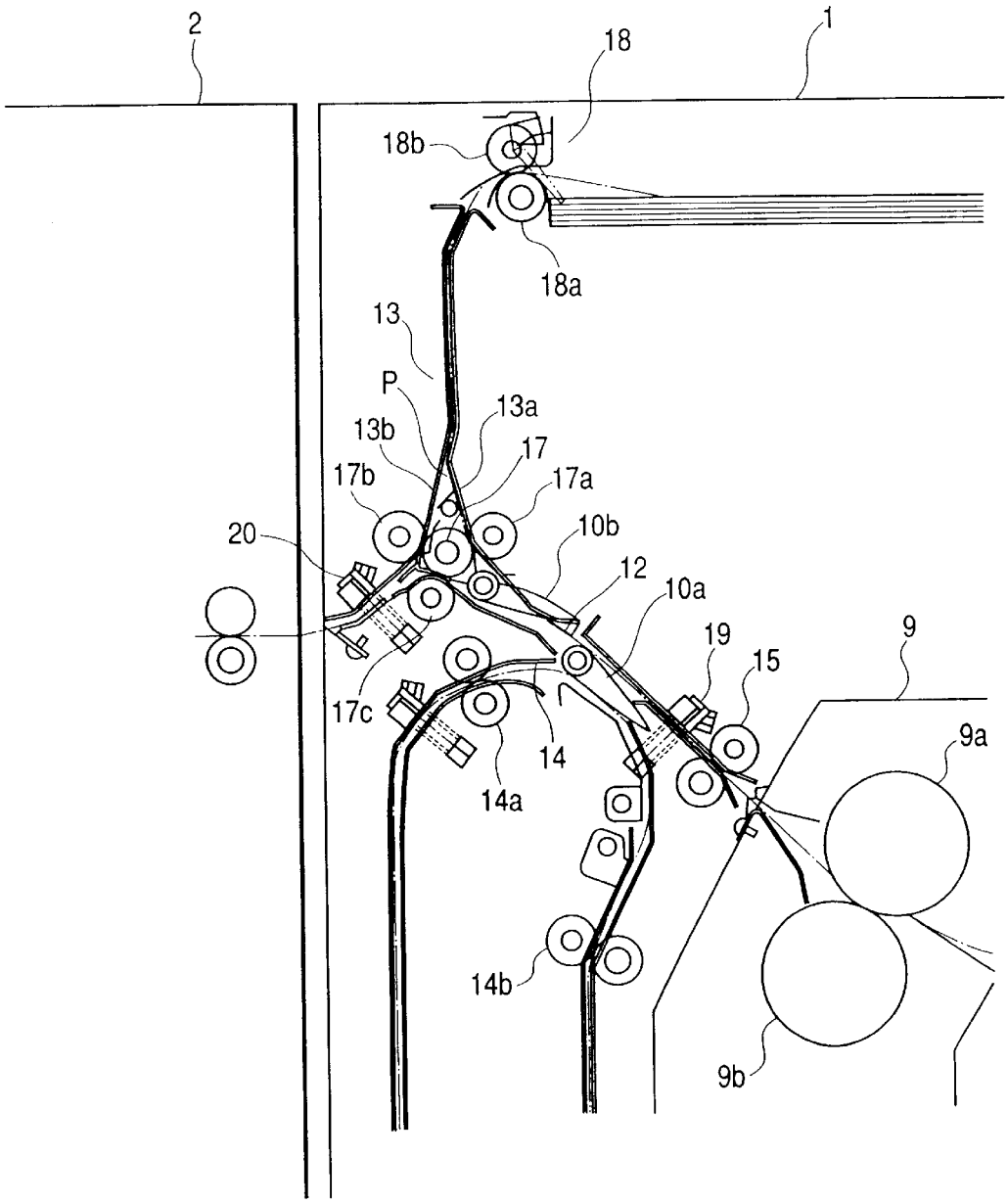
FIG. 1 is an explanatory view showing a transporting state of a sheet in a sheet reversing device of an image forming apparatus of the invention.

Next, the sheet transporting state in the sheet reversing device will be described with reference to FIGS. 1 and 2. In FIG. 1, reference numeral 19 is a first sensor, which is provided on the sheet feeding passage 12 at the downstream of the fixing device, and senses that the sheet has passed through the induction roller pair 17, 17*a*. Further, reference numeral 20 is a second sensor for sensing that the sheet has exhausted from the discharge roller pair 17, 17*b*. A smallest length in the transporting direction of the sheet used in the image forming apparatus of FIG. 1 is 7 inch, a distance (X) between a rear end of a preceding sheet and a leading end of a succeeding sheet during sheet transportation is 2 inch, and a sheet transporting velocity (V) in the sheet feeding passage 12 is 18 (inch/sec.) In FIG. 1, a length (L1) of a transporting passage between the induction roller pair 17, 17*a* and the reversal roller pair 18 is 6.6 inch, a length (L2) of a transporting passage between the reversal roller pair 18 and the feed roller pair 17, 17*b* is 6.6 inch, a length (S) of a transporting passage between the divergent point P and the reversal roller pair 18 is 5.3 inch, and a time (t) required for a deceleration/stop/acceleration process when the rotation of the reversal roller pair 18 is switched from the forward rotation to the reversal rotation or from the reversal rotation to the forward rotation is 0.1 (sec.). Under the above constitution, since the relation according to the first aspect of the invention is satisfied, the sheet having a length of at least 8.5 inch or less can be switch-backed and reversed without nip release of the reversal roller pair 18 and acceleration of the transporting velocity after the reversal.

Generally, a sheet size that is high in frequency of use is A4.LETTER size, and its length in the transporting direction is 8.5 inch or less in case of cross-feeding transportation. Therefore, the sheet of the size which is generally used most can be switch-backed and reversed without the nip release of the reversal roller pair 18 and acceleration of the transporting velocity after the reversal.

Figure 2:
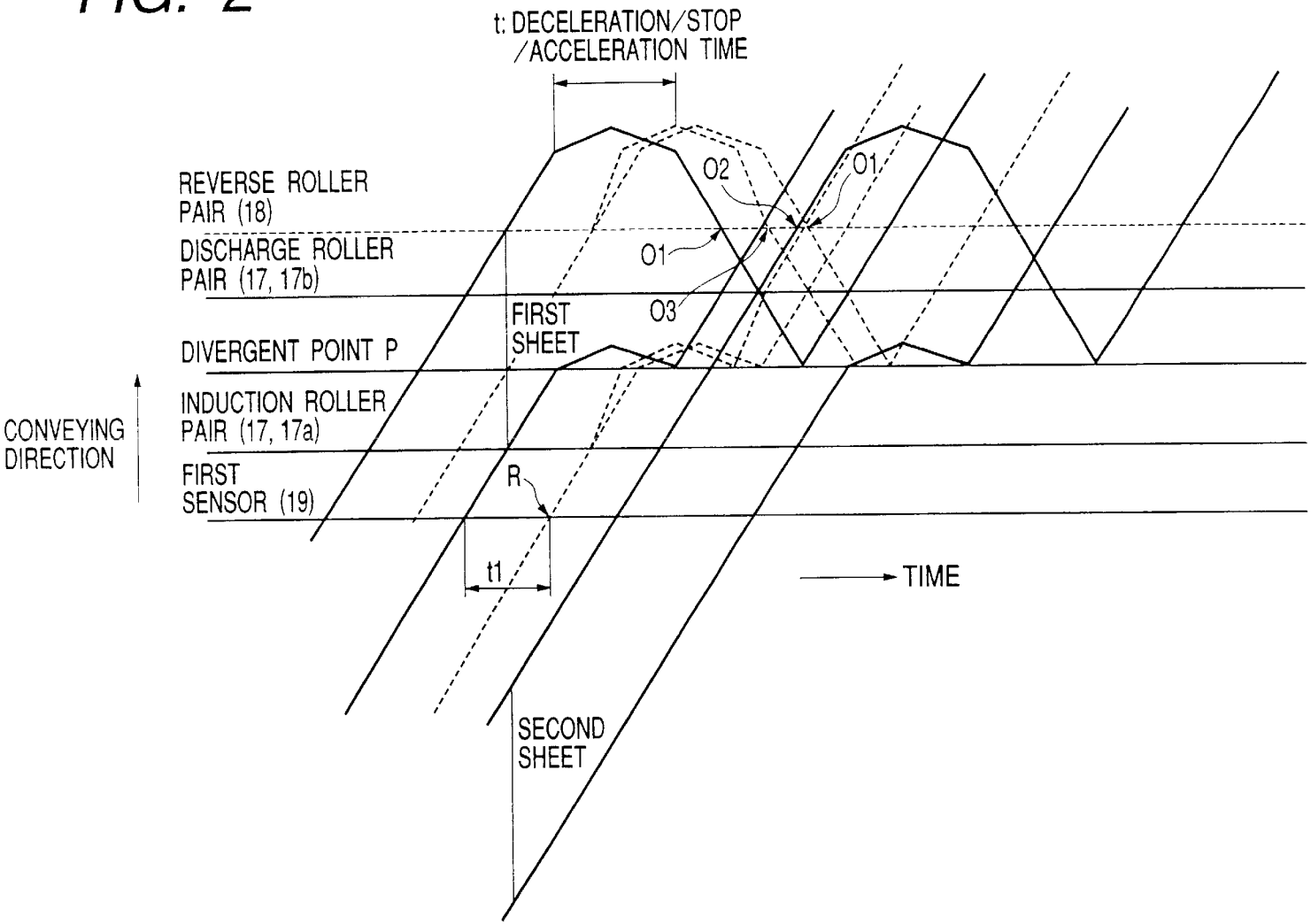
FIG. 2 is a time chart showing the transporting state of the sheet in the sheet reversing device of the invention.

FIG. 2 is a time chart showing a sheet transporting state in the sheet reversing device. FIG. 2 shows a relative relation of sheets that are transported, in which time is plotted in abscissa and sheet transporting distance is plotted in ordinate. A solid line in FIG. 2 represents a state in case that the sheets are normally transported. Two-dots chain line represents a state where transportation delay occurs in a preceding sheet 1. Reference sign Q1 represents a point where the rear end of the reversed preceding sheet 1 normally transported passes through the reversal roller pair 18. Reference sign Q2 represents a point where the leading end of a succeeding sheet 2 normally transported passes through the reversal roller pair 18. Reference sign Q1' represents a point where the rear end of the reversed preceding sheet 1 passes through the reversal roller pair 18 when the transportation delay occurs. As clear from FIG. 2, in case that the sheets are normally transported, since Q1 is located on the left side of Q2, after the rear end of the reversed preceding sheet 1 passes through the reversal roller pair 18, the succeeding sheet 2 reaches the reversal roller pair 18. Therefore, also in case that the nip release of the reversal roller pair 18 is not performed, the normal sheet transportation can be performed. However, in case that the transportation delay as shown by the two-dots chain line occurs in the preceding sheet 1, since Q1' is located on the right side of Q2, before the rear end of the reversed preceding sheet 1 passes through the reversal roller pair 18, the succeeding sheet 2 reaches the reversal roller pair 18. Therefore, the normal transportation cannot be performed. A broken line represents a state where the transportation delay correction according to the second aspect of the invention has been performed. In this case, when a point where the rear end of the preceding sheet 1 in which the transportation delay has occurred passes through the first sensor (19) is taken as R, difference t1 from the normal passing time is detected by a control means (not shown), and the transporting velocity by the reversal roller pair 18 after the rear end of preceding sheet 1 in which the transportation delay has occurred passed through the induction roller pair 17, 17*a* is changed into a velocity (V') represented by the following expression, whereby the transportation delay can be corrected.

$$V'=V\{1+V\cdot t1/(L1+L2-2\cdot S)\}$$

Actually, it is also possible to change the transporting velocity to the predetermined velocity to correct it regardless of the delay time. As a result, a point Q3 where the rear end of the reversed preceding sheet 1 of which the velocity has been corrected passes through the reversal roller pair 18 is located on the left side of the point Q2. Therefore, after the rear end of the reversed preceding sheet 1 passed through the reversal roller pair 18, the succeeding sheet 2 reaches the reversal roller pair 18, so that the normal sheet transportation can be performed also in a case that the nip release of the reversal roller pair 18 is not performed.

Next, in FIG. 1, reference numeral 18*a* is a drive roller constituting the reversal roller pair 18. Reference numeral 18*b* is a pinch roller provided separably in relation to the drive roller 18*a* by nip release mechanism (not shown) In a case that two sheets that move in the opposite direction to each other can be existed between the reversal roller pair 18 by releasing the nip of the reversal roller pair 18, as clear from FIG. 1, during reversing and transporting the preceding sheet, the succeeding sheet introduced into the pull-in passage 13*a* comes in to contact with the drive roller 18*a*. By the control means according to the third aspect of the invention, the rotation of the reversal roller pair 18 is switched to the forward rotation before the timer starting a clocking operation from the moment when the sheet leading end is sensed by the first sensor 19 points to a time when the sheet leading end reaches the reversal roller pair 18, which is calculated from the transporting velocity of the sheet and the distance between the first sensor 19 and the reversal roller pair. For this reason, also in a case that the succeeding sheet passes through the reversal roller pair 18 during reversing and transporting the preceding sheet, the relative velocity of the surface velocity between the succeeding sheet and the drive roller 18*a* can be made substantially zero, so that it is possible to prevent the leading end of the succeeding sheet from being bent and stained by the drive roller 18*a*.

Since the image forming apparatus having the exhausted sheet reversing mechanism according to the invention has the above constitution, the switch-back reversal can be performed without increasing the transporting velocity after the reversal of the sheet and without performing the nip release operation in case of the sheet of the size that is highest in frequency of use. Hereby, it is possible to suppress the noise that accompanies the nip release to a minimum, and it is possible to make the number of the nip release minimum in a lifetime of a product. Therefore, it is possible to suppress a lowering of reliability caused by abrasion of the nip release driving system to a minimum. Further, also in case that the transportation delay of sheet occurs, the transporting velocity can be so controlled that after the reversed and transported sheet passed through the reversal roller pair completely, the succeeding sheet reaches the reversal roller pair. Therefore, the reliability of the switch-back reversal without the nip release can be improved. Further, also in case that the sheet of the length requiring the nip release is switch-backed and reversed, bending and stain of the sheet that accompany the nip release can be prevented.

What is claimed is:

1. An image forming apparatus having a sheet reversing device, said sheet reversing device comprising:

a pull-in passage which is provided on the way of a first sheet transporting passage connecting a fixing device and an after treatment device to each other, and into which a sheet transported from the first sheet transporting passage is pulled; a reversal roller pair that is provided on the pull-in passage and provided so that it can rotate forward and reversely in order to reverse the advance direction of the sheet;

a nip release member adapted to release a nip of the reversal roller pair;

a first roller pair adapted to transport the sheet to a reversal passage that diverges from the pull-in passage at a divergent point located upstream of the reversal roller pair and to the pull-in passage; and a second roller pair adapted to transport the sheet transported from the reversal passage by reverse rotation of the reversal roller pair, and said sheet reversing device feeding out the sheet from the reversal passage in such a manner that a rear end of the sheet transported on the first transporting passage becomes a leading end in the transporting direction;

wherein there are provided said sheet reversing device so constituted that the following expression is satisfied, and a controller which, in case of a sheet having a length in the transporting direction of at least 8.5 inch or less, causes the sheet to reverse without the nip release of said reversal roller pair:

$$Y>L1>S>\{8.5\ (\text{inch})-X\}/2+V\cdot tY>L2,$$

where Y (inch) is the smallest length in the transporting direction of a sheet used in the image forming apparatus, X (inch) is a distance between a rear end of the preceding sheet and a leading end of the succeeding sheet during sheet transportation, L1 (inch) is a length of the transporting passage between the first roller pair and the reversal roller pair, L2 (inch) is a length of the transporting passage between the reversal roller pair and the second roller pair, S (inch) is a length of the transporting passage between the divergent point and the reversal roller pair, V(inch/sec.) is a sheet transporting velocity in the first sheet transporting passage, and t(sec.) is a time necessary for a deceleration/stop/acceleration step when the rotation of the reversal roller is switched from the forward rotation to the reverse rotation or from the reverse rotation to the forward rotation.

2. An image forming apparatus according to claim 1 further comprising:

a first sensor that is provided on said first transporting passage downstream of the fixing device and senses that the sheet has passed through the first roller pair.

3. An image forming apparatus having a sheet reversing device, said sheet reversing device comprising:

a pull-in passage which is provided on the way of a first sheet transporting passage connecting a fixing device and an after treatment device to each other, and into which a sheet transported from the first sheet transporting passage is pulled;

a reversal roller pair that is provided on the pull-in passage and provided so that it can rotate forward and reversely in order to reverse the advance direction of the sheet;

a nip release member adapted to release a nip of the reversal roller pair;

a first roller pair for transporting the sheet to a reversal passage that diverges from the pull-in passage at a divergent point located upstream of the reversal roller pair and to the pull-in passage;

a second roller pair for transporting the sheet transported from the reversal passage by reverse rotation of the reversal roller pair; and a first sensor that is provided on said first transporting passage downstream of the fixing device and senses that the sheet has passed through the first roller pair, and said sheet reversing device feeding out the sheet from the reversal passage in such a manner that a rear end of the sheet transported on the first transporting passage becomes a leading end in the transporting direction;

wherein there is provided a controller, which compares the sheet rear end sensing moment by the first sensor with a predetermined moment, and which, in case that the rear end sensing moment is later than the predetermined moment, makes a transporting velocity up to the divergent point of said pull-in passage and reversal passage and the reversal transporting velocity between said divergent point and the second roller pair larger than a regular transporting velocity.

4. An image forming apparatus having a sheet reversing device, said sheet reversing device comprising:

a pull-in passage which is provided on the way of a first sheet transporting passage connecting a fixing device and an after treatment device to each other, and into which a sheet transported from the first sheet transporting passage is pulled;

a reversal roller pair that is provided on the pull-in passage and provided so that it can rotate forward and reversely in order to reverse the advance direction of the sheet;

a nip release member adapted to release a nip of the reversal roller pair;

a first roller pair for transporting the sheet to a reversal passage that diverges from the pull-in passage at a divergent point located upstream of the reversal roller pair and to the pull-in passage;

a second roller pair for transporting the sheet transported from the reversal passage by reverse rotation of the reversal roller pair; and a first sensor that is provided on said first transporting passage downstream of the fixing device and senses that the sheet has passed through the first roller pair, and said sheet reversing device feeding out the sheet from the reversal passage in such a manner that a rear end of the sheet transported on the first transporting passage becomes a leading end in the transporting direction;

wherein a roller of the reversal roller pair on a side corresponding to the pull-in passage is constituted as a drive roller and a roller on a side corresponding to the reversal passage is constituted as a pinch roller, wherein the pinch roller is constituted separately from the drive roller, and wherein there is provided a controller which, after a leading end of the sheet was sensed by the first sensor, rotates forward the drive roller of the reversal roller pair, which is calculated from the position of said reversal roller pair on the pull-in passage, passes.

* * * * *